US010028581B2

(12) United States Patent
Chen

(10) Patent No.: US 10,028,581 B2
(45) **Date of Patent: *Jul. 24, 2018**

(54) ADJUSTABLE FACE PLATE MOUNTING SYSTEM AND METHOD OF USE

(71) Applicant: Hardware Resources, Inc., Bossier City, LA (US)

(72) Inventor: Alan Chen, Lewisville, TX (US)

(73) Assignee: Hardware Resources, Inc., Bossier City, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/608,815

(22) Filed: May 30, 2017

(65) Prior Publication Data

US 2017/0258227 A1 Sep. 14, 2017

Related U.S. Application Data

(60) Continuation of application No. 14/797,996, filed on Jul. 13, 2015, now Pat. No. 9,661,924, which is a (Continued)

(51) Int. Cl.
*A47B 88/00* (2017.01)
*A47B 88/45* (2017.01)
(Continued)

(52) U.S. Cl.
CPC ..... *A47B 88/45* (2017.01); *A47B 88/42* (2017.01); *A47B 88/493* (2017.01);
(Continued)

(58) Field of Classification Search
CPC ..... A47B 88/42; A47B 88/931; A47B 88/956; A47B 88/95; A47B 2088/951;
(Continued)

(56) References Cited

U.S. PATENT DOCUMENTS 2,254,431 A 9/1941 Levine
2,987,364 A 6/1961 Fall
(Continued)

FOREIGN PATENT DOCUMENTS

EP 0582775 A1 2/1994

OTHER PUBLICATIONS

"Adjustable PullOut Cabinet Rack for 14" Deep Pantry Systems," Side Lines®, sidelinesinc.com, SKU#B01545Sc14, http://www.sidelinesinc.com/product_display.php?pid=71.
(Continued)

*Primary Examiner* — Daniel J Rohrhoff
(74) *Attorney, Agent, or Firm* — Schultz & Associates, P.C.

(57) ABSTRACT

Disclosed is an adjustable face plate mounting system for adjusting the position of a face plate attached to a pantry pullout apparatus. The system comprises a slotted bracket adjustably attached to the face plate, a standoff assembly attached to the pantry pullout apparatus and slidably engaged with the slotted bracket, a fastener fixedly attached to the pantry pullout apparatus, and a set crew movable within the fastener and abutting the slotted bracket. A first embodiment of the standoff assembly includes a pair of standoffs and coordinating removable fasteners. Another embodiment of the standoff assembly includes a single standoff and fastener paired with a pin. The face plate is adjustable in three dimensions with respect to the pantry pullout apparatus and surrounding cabinets.

20 Claims, 17 Drawing Sheets

Related U.S. Application Data division of application No. 14/797,643, filed on Jul. 13, 2015, now Pat. No. 9,565,936.

(60) Provisional application No. 62/076,602, filed on Nov. 7, 2014.

(51) Int. Cl.

| | |
|---|---|
| ***A47B 88/42*** | (2017.01) |
| ***A47B 88/931*** | (2017.01) |
| ***A47B 88/969*** | (2017.01) |
| ***A47B 88/493*** | (2017.01) |
| ***A47B 88/956*** | (2017.01) |

(52) U.S. Cl.

CPC ..... *A47B 88/931* (2017.01); *A47B 88/956* (2017.01); *A47B 88/969* (2017.01)

(58) Field of Classification Search

CPC ..... A47B 2088/952; A47B 2088/954; A47B 88/0055; A47B 88/00044; A47B 88/0051; A47B 2088/0059; A47B 2088/0062; A47B 2088/007; A47B 2088/0074

See application file for complete search history.

(56) References Cited

U.S. PATENT DOCUMENTS

| | | | | |
|---|---|---|---|---|
| 3,874,756 | A | 4/1975 | Greene | |
| 4,621,876 | A | 11/1986 | Reimer | |
| 4,653,818 | A | 3/1987 | DeBruyn | |
| 5,671,987 | A | 9/1997 | Hommes | |
| 5,944,400 | A | 8/1999 | Fulterer | |
| 5,992,956 | A | 11/1999 | Slivon | |
| 6,135,584 | A | 10/2000 | Happ | |
| 6,199,966 | B1 | 3/2001 | Fulterer | |
| 6,231,138 | B1 | 5/2001 | Janson | |
| 6,682,159 | B2 | 1/2004 | Compagnucci | |
| 6,688,708 | B1 | 2/2004 | Janson | |
| 7,306,301 | B2 | 12/2007 | Walburn | |
| D596,424 | S | 7/2009 | Noe et al. | |
| RE41,725 | E | 9/2010 | Walburn | |
| 7,832,816 | B2 | 11/2010 | Compagnucci | |
| 8,047,621 | B2 * | 11/2011 | Walburn | A47B 88/956 312/265.5 |
| 8,109,581 | B1 | 2/2012 | Lazenby | |
| 9,101,213 | B2 | 8/2015 | McGregor | |
| 9,259,087 | B1 | 2/2016 | Hsiao | |
| 9,661,924 | B2 * | 5/2017 | Chen | A47B 88/42 |
| 2004/0232810 | A1 | 11/2004 | Kreyenkamp | |
| 2005/0093407 | A1 * | 5/2005 | Feeley | A47B 88/956 312/348.4 |
| 2006/0001337 | A1 | 1/2006 | Walburn | |
| 2008/0067303 | A1 * | 3/2008 | Compagnucci | A47B 96/068 248/201 |
| 2009/0267470 | A1 | 10/2009 | Compagnucci | |
| 2012/0049713 | A1 * | 3/2012 | Tingle | A47B 88/42 312/334.33 |
| 2012/0217214 | A1 | 8/2012 | Thomsen | |
| 2012/0286116 | A1 * | 11/2012 | Gasser | A47B 88/0055 248/221.11 |
| 2013/0088134 | A1 | 4/2013 | Vamer et al. | |
| 2014/0072366 | A1 * | 3/2014 | Holzapfel | F16B 12/02 403/326 |
| 2014/0077678 | A1 * | 3/2014 | Holzapfel | A47B 88/0055 312/348.4 |
| 2014/0139080 | A1 | 5/2014 | Pan | |
| 2014/0239787 | A1 * | 8/2014 | Mensa' | A47B 88/0055 312/348.4 |
| 2015/0282617 | A1 * | 10/2015 | Chen | A47B 88/0055 312/348.4 |
| 2016/0007744 | A1 | 1/2016 | Fasino et al. | |

OTHER PUBLICATIONS

"Pantry Pull Out Slide FR 777 200 Kg," tt thuresson™, http://www.thuressontrading.com/pantrypulloutslidefr777200kg.Html.

"PullOut Pantry 300mm Module Chrome Finish Baskets," ELRACO, http://elraco.com.au/product_info.php/standardpantryunitpulloutpantry300mmmodulechromefinishbasketsp9496.

"PullOut Pantry Chrome 5200 Series RevAShelf," CMS Cabinetmaker's Supply, cabinetmakerssupply.com, http://www.cabinetmakerssupply.com/pull_out_pantry_chrome_5200_series_rev_a_shelf cabinet_wire_5593_prd1.htm.

"RevAShelf &ldqou;Premiere" Chrome SoftClose Pullout Pantry, kitchensource, kitchensource.com, http://www.kitchensource.com/pantry/rv574309.htm.

* cited by examiner

ADJUSTABLE FACE PLATE MOUNTING SYSTEM AND METHOD OF USE

CROSS-REFERENCE TO RELATED APPLICATIONS

This application is a Continuation of application Ser. No. 14/797,996, filed Jul. 13, 2015, which is a Divisional of application Ser. No. 14/797,643, filed on Jul. 13, 2015, issued as U.S. Pat. No. 9,565,936 on Feb. 14, 2017, which claims the benefit of U.S. Provisional Patent Application No. 62/076,602 filed on Nov. 7, 2014. Each patent application identified above is incorporated herein by reference in its entirety to provide continuity of disclosure.

FIELD OF THE DISCLOSURE

The present disclosure relates to cabinet structure, cabinets, and drawers. In particular, the disclosure relates to a face plate mounting system adjustably connected to a slidable cabinet piece.

BACKGROUND OF THE DISCLOSURE

Modern kitchens place a premium on sufficient usage of storage for utensils, dry goods, and can goods. In the past, the traditional pantry includes simple shelving to accommodate these items. However, simple shelving suffers from the drawback of unusable rear areas in corners where items are difficult to see and reach.

In an effort to overcome these difficulties, the prior has responded by various pantry pull out devices.

For example, U.S. Pat. No. 7,832,816 to Compagnucci discloses a frame used to support racks that slide out from a cabinet and rotate around a vertical axis. The frame comprises a rectangular structure formed of two uprights connected by upper and lower cross-pieces. The cross-pieces are coupled to telescopic sliding assemblies mounted within the cabinet. The cross-pieces are pinned to the sliding assemblies to allow the rack to rotate approximately 90° on a vertical axis such that the frame becomes parallel with the face of the cabinet only at a fully deployed position. Stops mounted to the cross-pieces prevent the frame from sliding to a stored position within the cabinet before the frame is rotated 90° such that the frame is parallel with the sliding assemblies. The device does not provide a self centering mounting base or an adjustable face plate.

U.S. Pat. No. 6,199,966 to Fulterer discloses a pullout device for a tall cupboard. The device comprises upper and lower sliding assemblies including telescopically sliding rails and running rollers. A vertically extending pullout frame, which is formed of vertical front and rear bars and horizontal upper and lower bars, is secured to the sliding assemblies. The front and rear bars and the upper and lower bars can be formed as telescopic members, permitting to adapt the device to the dimensions of the tall cupboard. A plurality of baskets can be hung between the vertical. A frontal screen is secured to the front vertical bar. The frontal screen is not easily adjustable.

U.S. Reissue Pat. No. RE41,725 to Walburn discloses a drawer slide system providing desired access and stability for a side access drawer. The system comprises a drawer having a front wall, a back wall, a base, and plurality of shelves connected between the front and back walls. The base includes a pair of vertical webs. The base is slidably mounted on a sliding assembly comprised of one horizontally oriented drawer slide and a pair of vertically oriented drawer slides mounted to vertical webs of the base. The drawer does not provide a self centering mounting base or an adjustable face plate.

Despite the advantages of the prior art, a major drawback has been that the pullout devices disclosed are not easily installed or adjusted. The prior art fails to disclose or suggest a pullout pantry device that is easily and accurately mounted and which is easily adjustable to accommodate alignment with adjacent cabinets. Therefore, there is a need for a slidable pantry pullout apparatus which is easily and accurately installed in a preexisting cabinet space where the apparatus is adjustable to ensure a coordinated and professional look which assimilates with cabinets already installed.

SUMMARY OF THE DISCLOSURE

In a preferred embodiment, a pantry pullout apparatus is comprised of a drawer box slidably mounted within a cabinet carcass. The drawer box is comprised of a rear panel separated from a front panel by a plurality of adjustable shelves and fixed shelves. The drawer box is fixed to a base slide box. The base slide box is comprised of a slotted template slidingly engaged with a frame, where the frame is mounted to the cabinet carcass. Slide rail assemblies connect the slotted template to the frame. A pin block on the underside of a fixed shelf automatically centers the drawer box on the slotted template. A top slide assembly is mounted to the drawer box and the cabinet carcass. The top slide assembly can be adjusted horizontally and vertically with respect to the drawer box and cabinet carcass to accommodate particular dimensions of various drawer boxes and cabinet carcasses. A cosmetic cover is attached to the slotted template and hides the slide rail assemblies connecting the slotted template to the base slide box from view.

In a preferred embodiment, a decorative face plate is attached to the front panel of the drawer box with an adjustable face plate mounting system. A slotted, rectangular bracket providing horizontal and vertical adjustment capability is connected to the face plate. A standoff assembly slidably engages the slot in the bracket and is fixed to the front panel. In an alternate embodiment, a T-nut is fixedly engaged with the front panel and an adjustable set screw is threadably engaged with the T-nut. The adjustable set screw abuts the slotted bracket to provide depth adjustment capability.

BRIEF DESCRIPTION OF THE DRAWINGS

The disclosed embodiments will be described with reference to the accompanying drawings. Like pieces in different drawings are referenced by the same number.

DETAILED DESCRIPTION

Figure 1A:
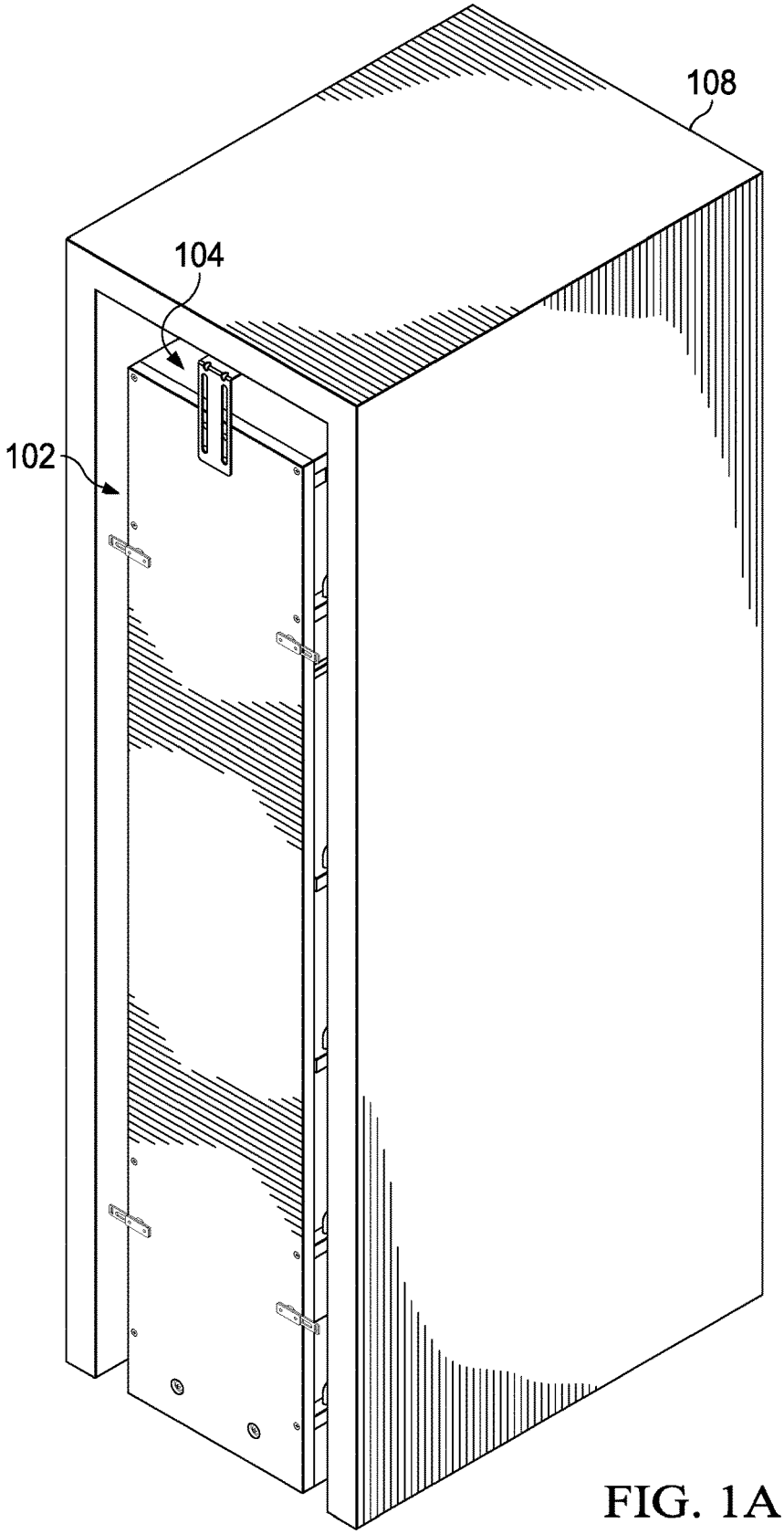
FIG. 1A is an isometric view of a preferred embodiment in a stowed position.
Figure 1B:
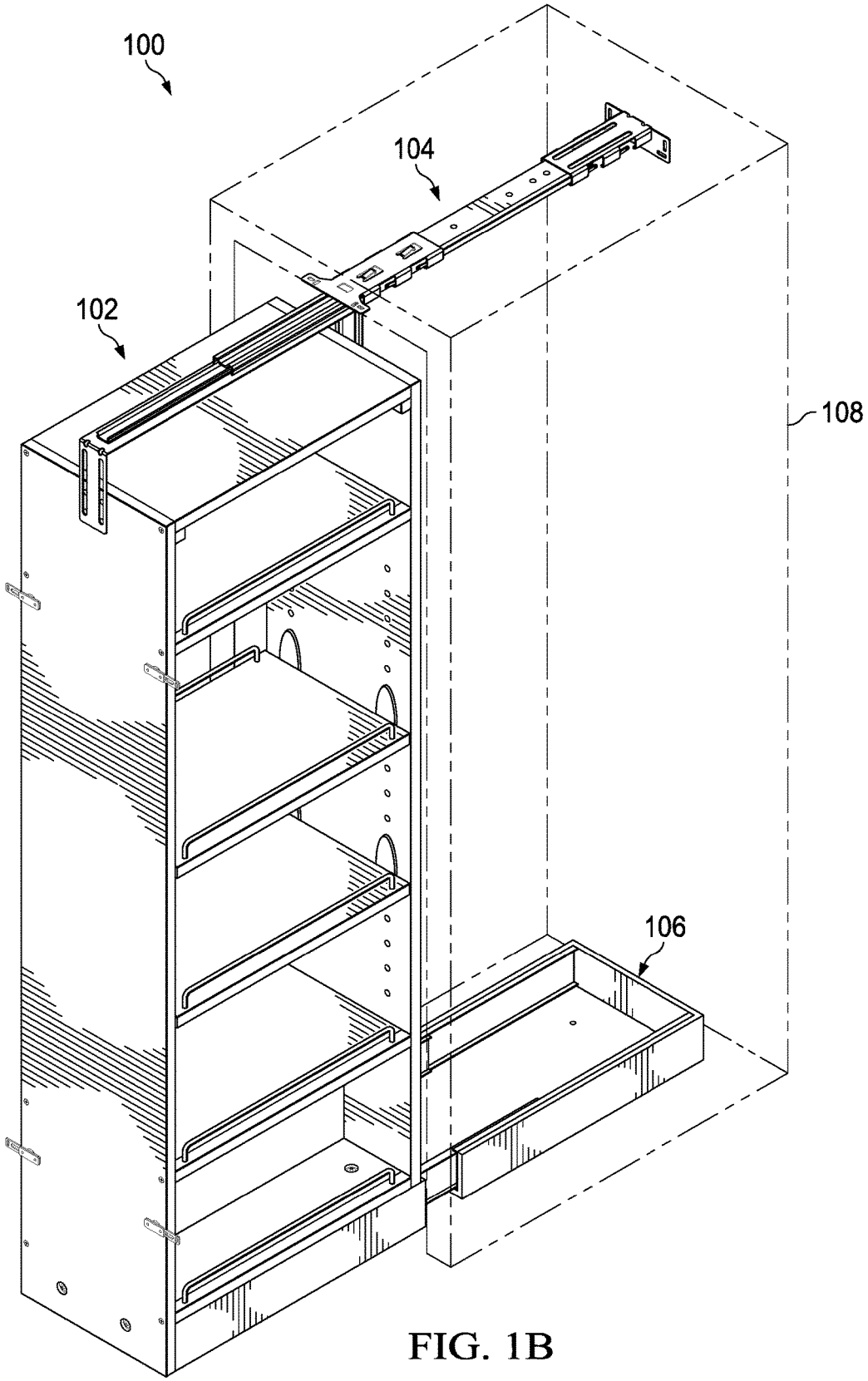
FIG. 1B is an isometric view of a preferred embodiment in a deployed position.

Referring to FIGS. 1A and 1B, pantry pullout apparatus 100 comprises drawer box 102 connected to top slide assembly 104 and base slide box 106. Drawer box 102 is connected to and slidable within base slide box 106. Top slide assembly 104 and base slide box 106 are mounted to cabinet carcass 108. Drawer box 102 is slidable between a "stowed" position within the cabinet carcass (FIG. 1A) and a "deployed" position (FIG. 1B). In the stowed position, the drawer box and its contents are hidden from view. In the deployed position, the contents stored on the shelves are visible and capable of being easily reached from either side.

Figure 2:
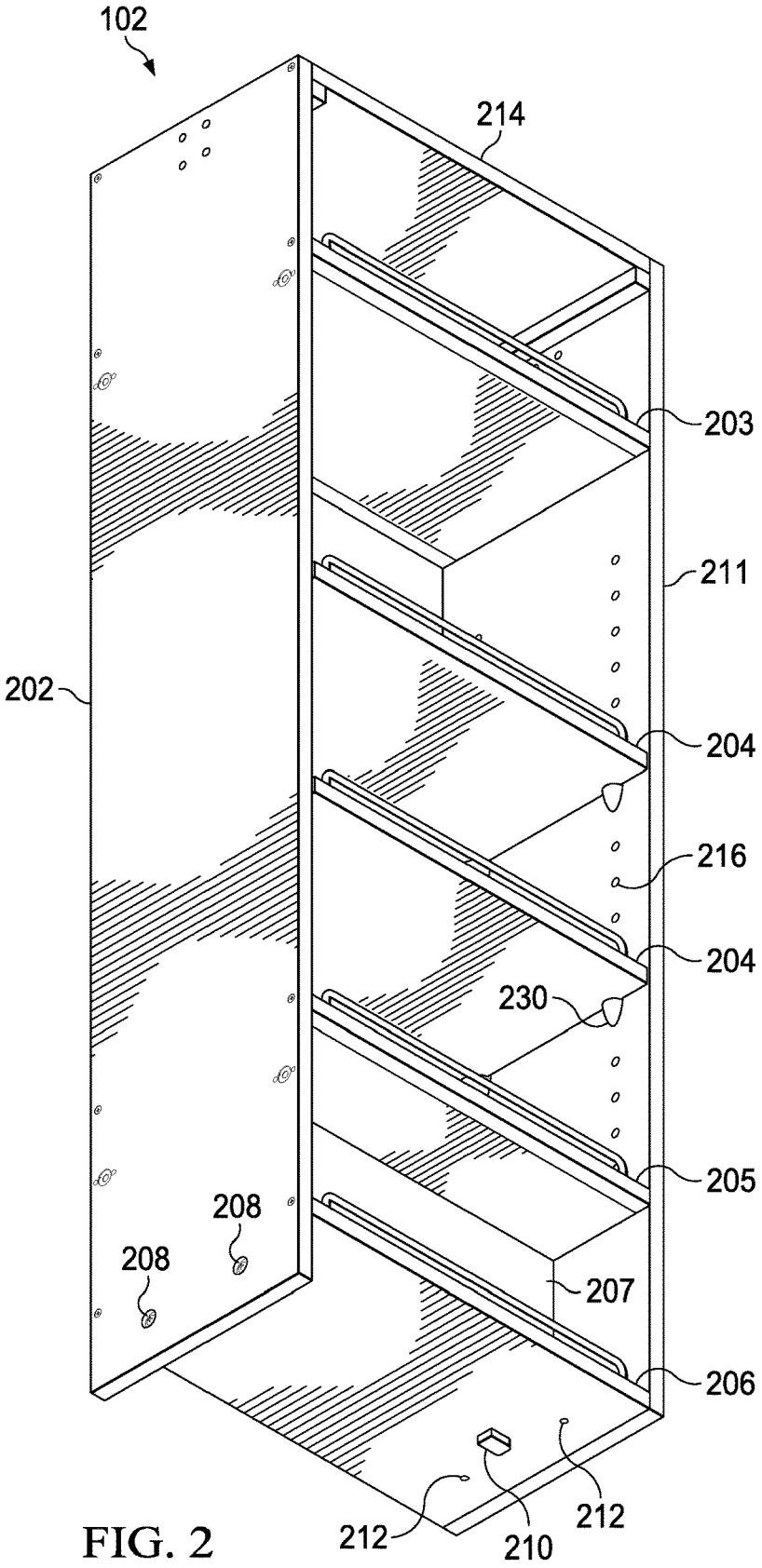
FIG. 2 is an isometric view of a drawer box of a preferred embodiment.

Referring to FIG. 2, drawer box 102 is generally rectangular having a closed top and bottom with open sides. Drawer box 102 comprises front panel 202 connected to rear panel 211 by top panel 214. Fixed shelves 203, 205, and 206 are rigidly connected to and generally perpendicular with both front panel 202 and rear panel 211. A plurality of adjustable shelves 204 span the distance between front panel 202 and rear panel 211. The vertical position of each adjustable shelf 204 can be changed by repositioning supporting pins 230 in a series of evenly spaced and aligned mounting holes 216 in front panel 202 and rear panel 211 located between fixed shelves 203 and 205. Vertical partition 207 extends between and is connected to fixed shelves 205 and 206. Pin block 210 is rigidly secured to the underside of fixed shelf 206 and is positioned on the longitudinal central axis of fixed shelf 206. Front panel 202 includes a pair of mounting holes 208 proximate fixed shelf 206. Fixed shelf 206 includes a pair of mounting holes 212. In a preferred embodiment, drawer box 102 is formed of wood, partical board, or polyvinyl chloride (PVC).

Figure 3:
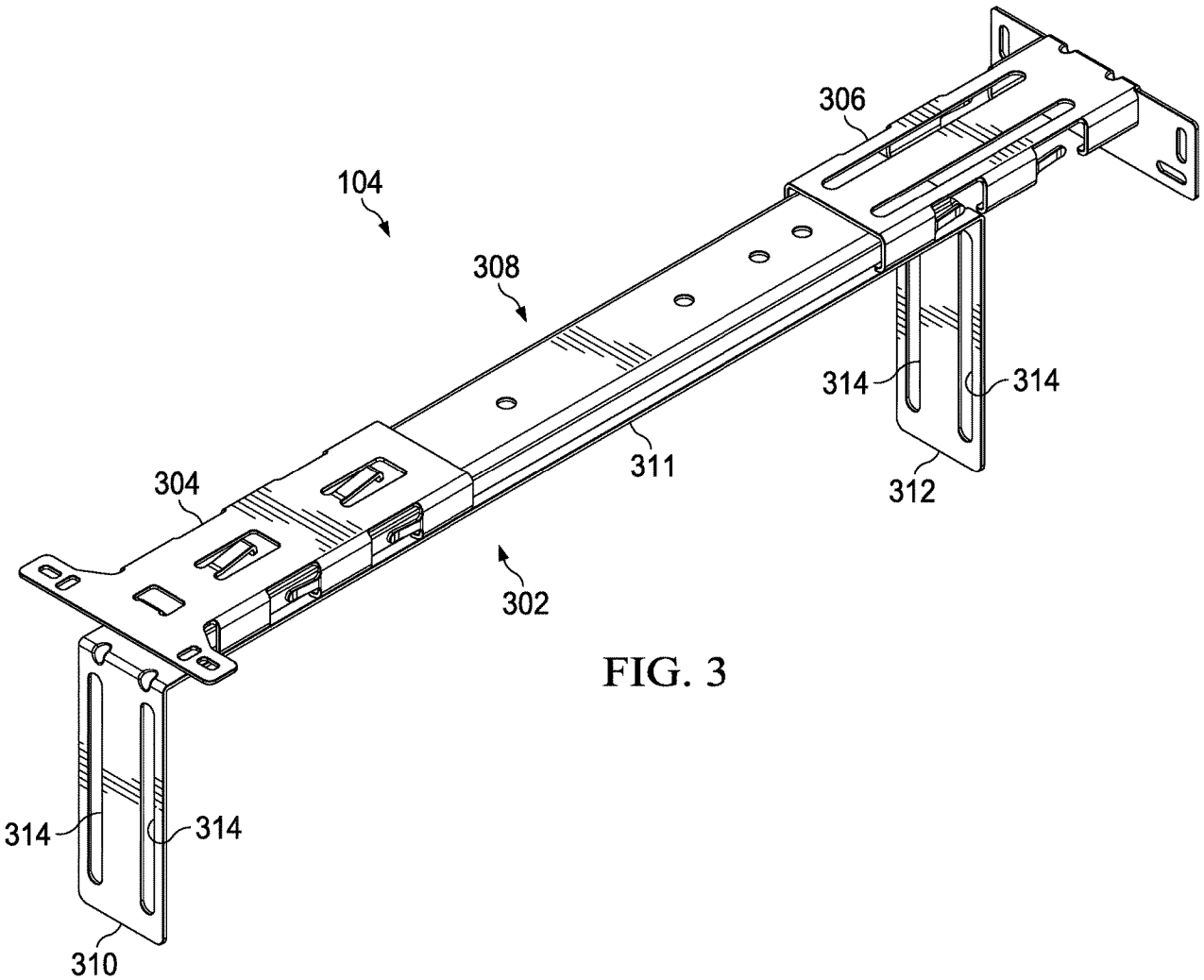
FIG. 3 is an isometric view of a top slide assembly of a preferred embodiment.

Referring to FIG. 3, top slide assembly 104 is shown. Top slide assembly 104 comprises rail assembly 308 mounted to "U" bracket 302. "T" bracket 304 and "L" bracket 306 are both adjustably engaged with rail assembly 308 and adjustably connected to the cabinet carcass. "U" bracket 302 comprises bridge 311 having a length approximately equal to the length of the fixed and adjustable shelves. Flanges 310 and 312 extend generally perpendicularly from the ends of bridge 311. Flanges 310 and 312 include mounting slots 314. In a preferred embodiment, the components of top slide assembly 104 are formed of steel, preferably stainless steel.

Figure 4:
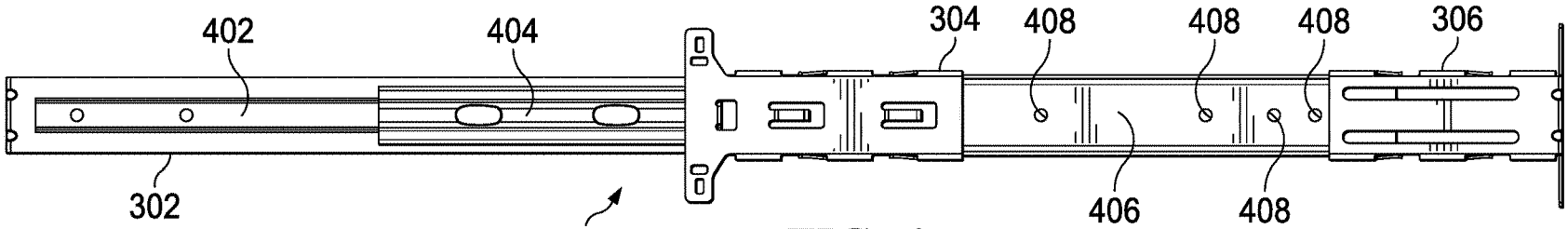
FIG. 4 is an elevation view of a top slide assembly of a preferred embodiment.

As shown in FIG. 4, rail assembly 308 comprises inner rail 402 connected to "U" bracket 302. Inner rail 402 slidingly engages intermediate rail 404. Intermediate rail 404 sliding engages outer rail 406. In a preferred embodiment, the inner rail and intermediate rails are engaged by typical race and caged ball-bearing assemblies. In alternate embodiments, different numbers of slide rails and alternate sliding engagements may be employed. "T" bracket 304 and "L" bracket 306 are adjustably attached to outer rail 406. Outer rail 406 includes linearly aligned mounting holes 408. Mounting holes 408 are positioned along the longitudinal center axis of outer rail 406.

Figure 5A:
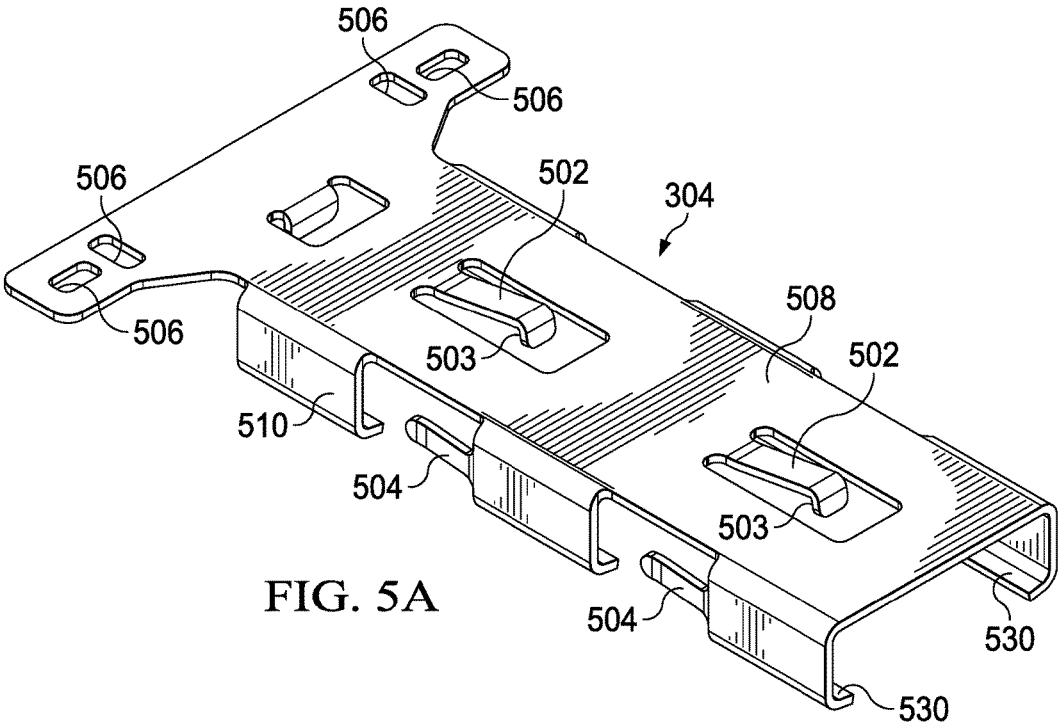
FIG. 5A is an isometric view of a "T" bracket of a preferred embodiment.
Figure 5B:
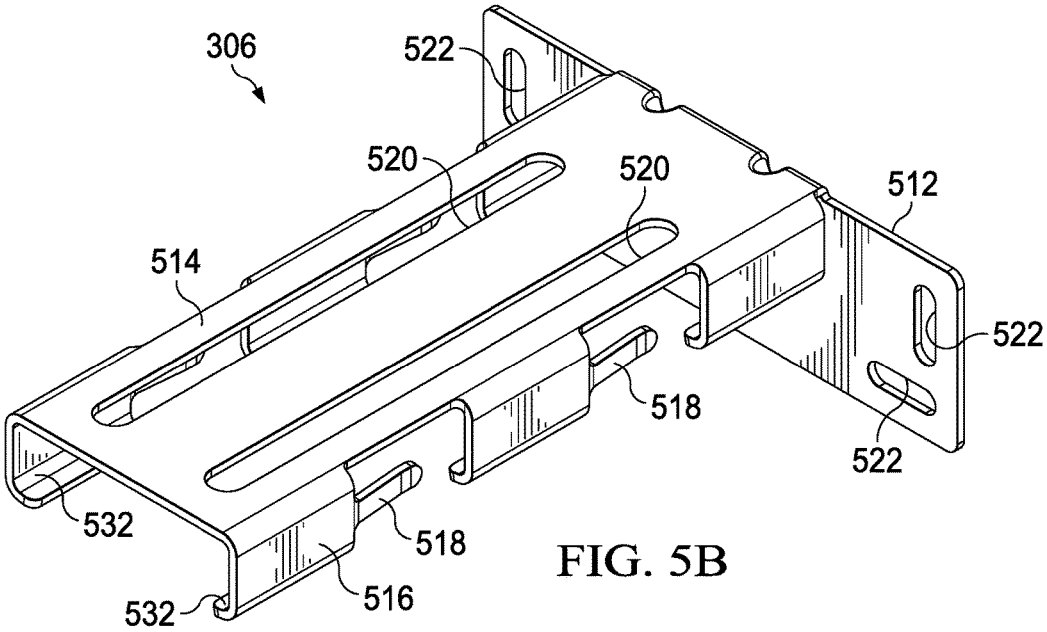
FIG. 5B is an isometric view of an "L" bracket of a preferred embodiment.

Referring to FIGS. 5A and 5B, brackets 304 and 306 are shown. Brackets 304 and 306 releasably engage rail assembly 308. "T" bracket 304 has a generally "U" shaped cross-section comprised of web 508 integrally formed with and separating sides 510. Tabs 504 extend from each of sides 510. Tabs 504 are angled inward towards web 508 such that they act as a spring and provide an inward bias. Flexible tabs 502 extend from web 508. Each flexible tab 502 includes hook 503 sized to engage mounting holes 408 on outer rail 406. Sides 510 extend from web 508 and include curve 530. "T" Bracket 304 includes mounting holes 506.

"L" bracket 306 has a generally "U" shaped cross-section comprised of web 514 integrally formed with sides 516. Web 514 includes mounting slots 520. Flange 512 extends generally perpendicularly from web 514 and includes mounting slots 522. Sides 516 extend from web 514 and include curve 532. Tabs 518 extend from each of sides 516. Tabs 518 are angled inward towards web 514 such that they act as a spring and provide an inward bias.

Figure 6:
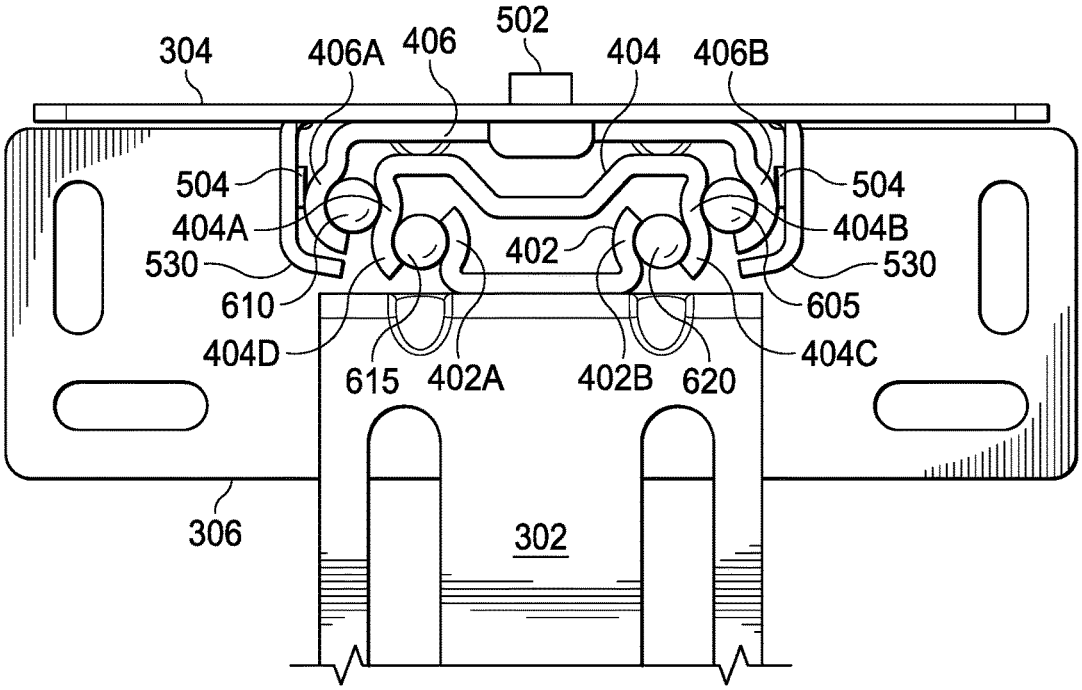
FIG. 6 is a partial elevation view of a top slide assembly of a preferred embodiment.

Referring to FIG. 6, rail assembly 308 is shown attached to "U" bracket 302. Inner rail 402 is nested within intermediate rail 404. Intermediate rail 404 is nested within outer rail 406.

Intermediate rail 404 includes bearing race 402*a* and rail bearing race 402*b*. Intermediate rail 404 includes bearing race 404*c* and bearing race 404*d*. The bearing races cooperate to position ball bearing string 615 and ball bearing string 620. Intermediate rail 404 also includes bearing race 404*a* and bearing race 404*b*. Outer rail 406 includes bearing race 406*a* and bearing race 406*b*. The bearing races cooperate to locate ball bearing strings 605 and 610. Curves 530 hook under outer rail 406 and tabs 504 abut outer rail 406. Tabs 504 and 518 accommodate a range of widths of outer rail 406.

Figure 7:
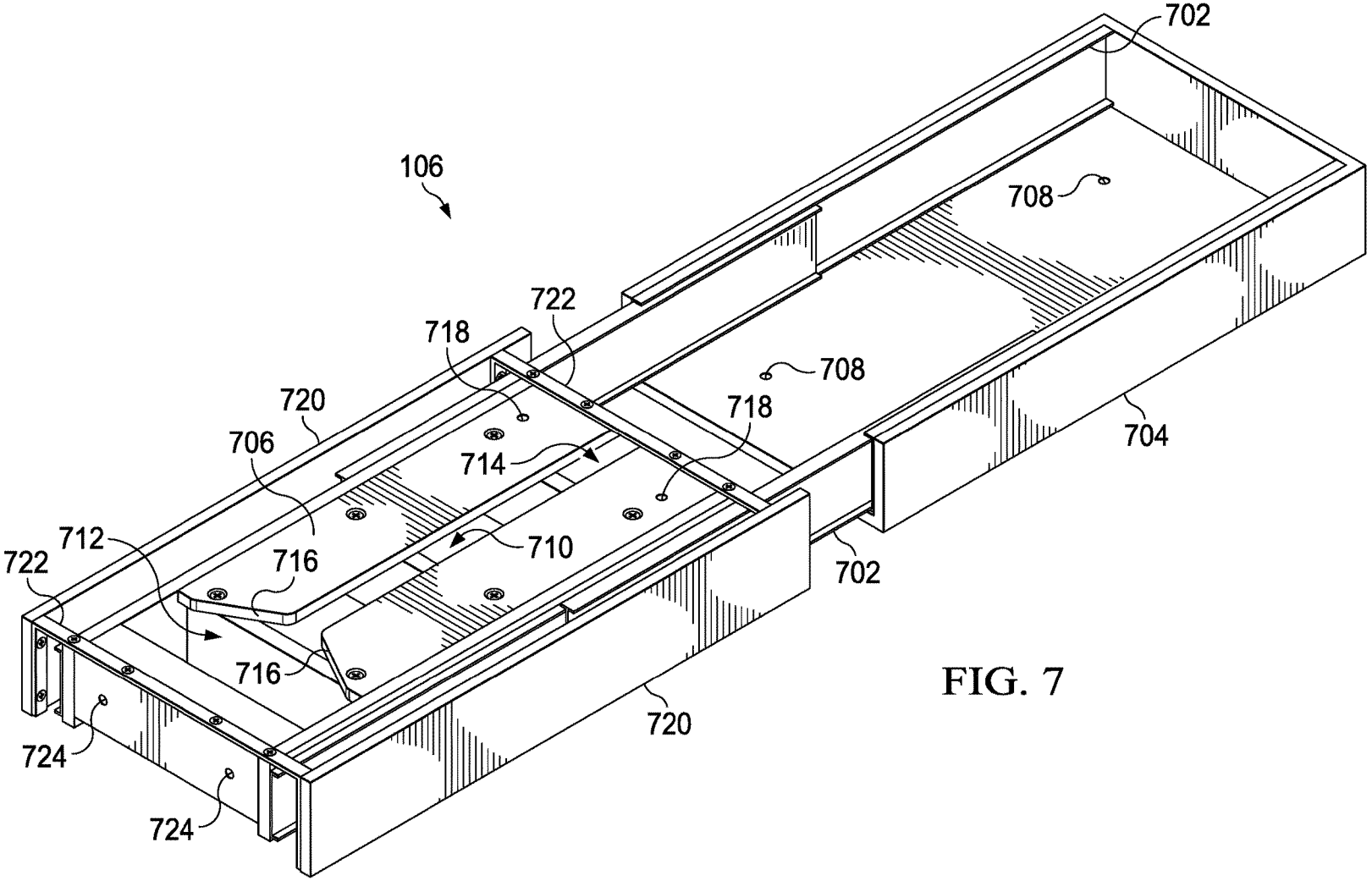
FIG. 7 is an isometric view of a base slide box of a preferred embodiment.

Referring to FIG. 7, base slide box 106 is shown. In a preferred embodiment, base slide box 106 is formed of wood, particle board, or polyvinyl chloride (PVC). Rail assembly 702 slidably connects frame 704 to template 706. In a preferred embodiment, rail assembly 702 incorporates three sliding rails with ball-bearing carriages; however, alternate forms of drawer rail assemblies may be employed. Frame 704 includes a plurality of mounting holes 708. Template 706 includes slot 710 located on its central longitudinal axis. Slot 710 has a first end 712 and a second end 714. Redirecting surfaces 716 are positioned at first end 712 of slot 710. In a preferred embodiment, redirecting surfaces 716 are angled generally 45° from the longitudinal axis of slot 710, however angles in the range of 30-60° would suffice. Template 706 includes mounting holes 718 either side of slot 710 proximate second end 714. A front face of template 706 includes mounting holes 724. Cosmetic cover 720 is comprised of two panels connected to each other by a pair of braces 722. Braces 722 are mounted to template 706 at first end 712 and second end 714. Cosmetic cover 720 hides rail assembly 702 from view when drawer box 102 is in the deployed position. In an alternate embodiment, no cosmetic cover is attached to base slide box 106.

Figure 8A:
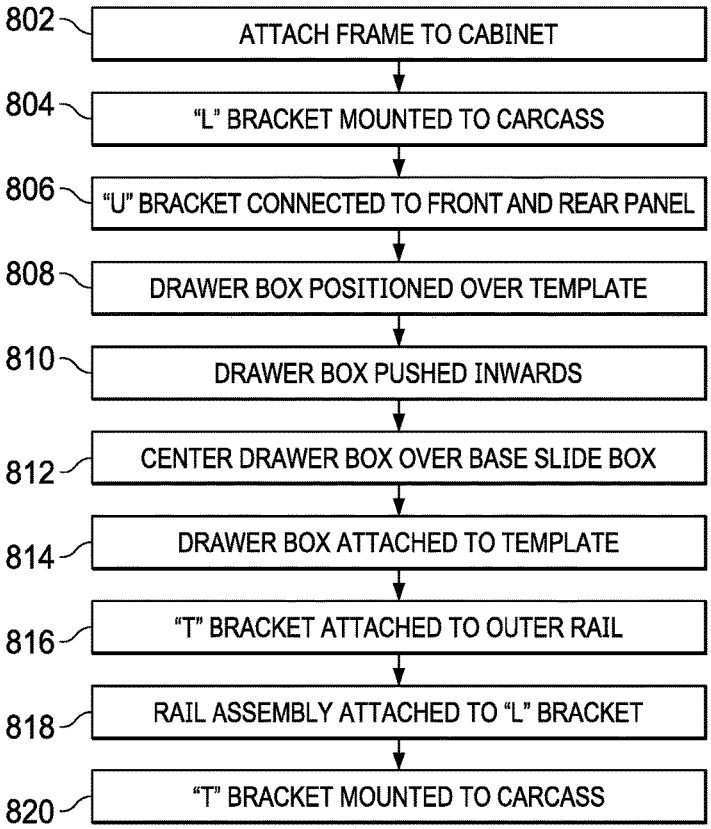
FIG. 8A is a flowchart of the steps involved in installing a drawer box in a cabinet of a preferred embodiment.
Figure 8B:
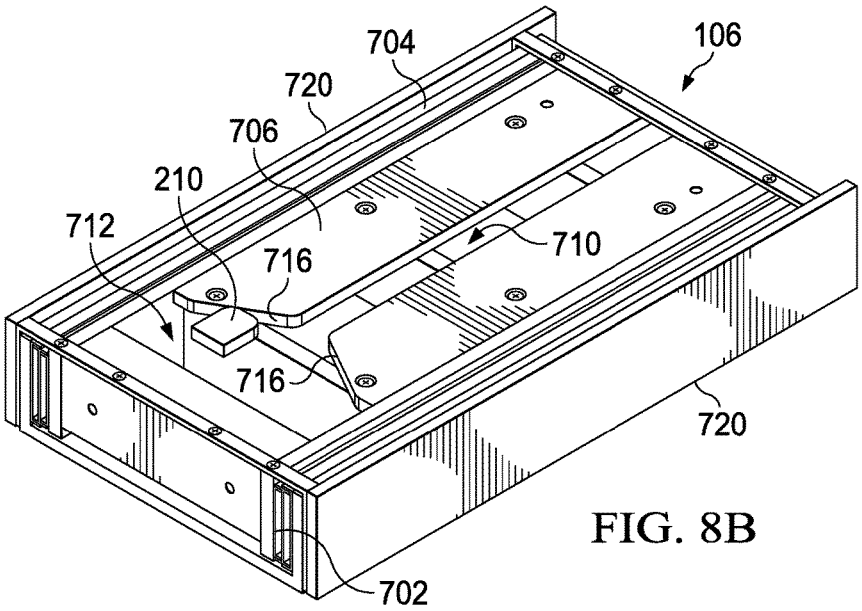
FIG. 8B is an isometric view of a base slide box of a preferred embodiment with a pin block in an initial position.
Figure 8C:
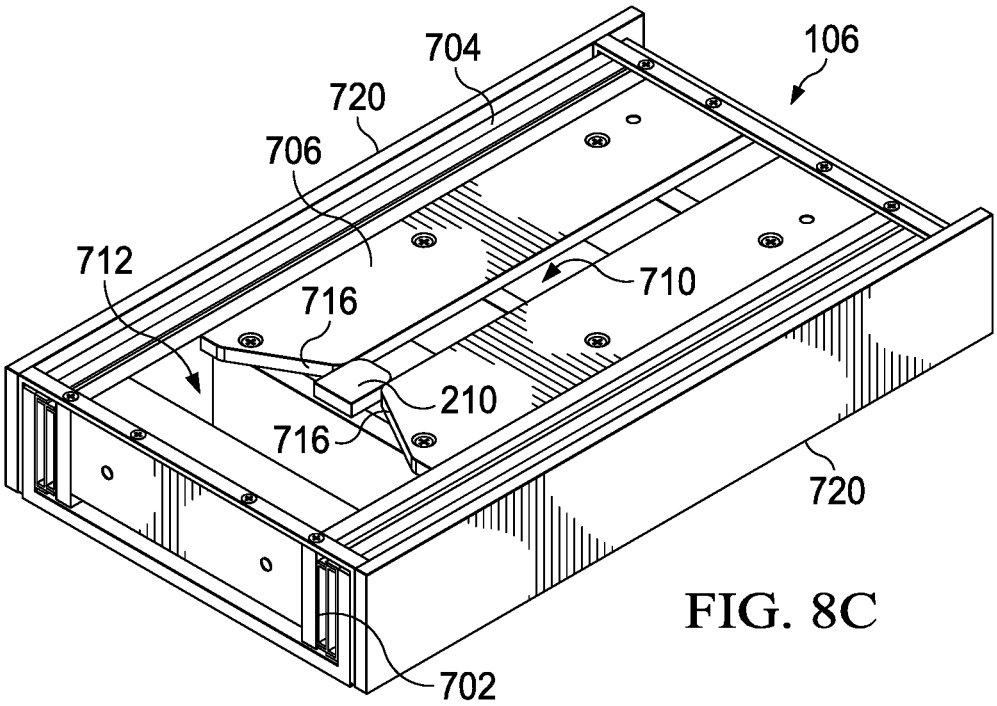
FIG. 8C is an isometric view of a base slide box of a preferred embodiment with a pin block in an intermediate position.
Figure 8D:
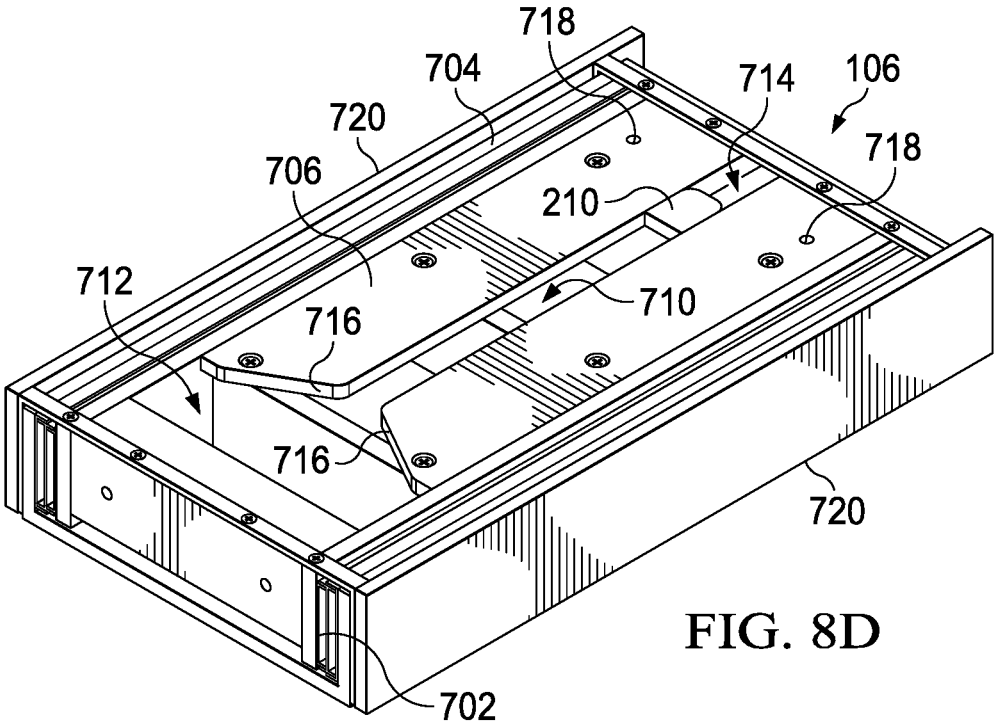
FIG. 8D is an isometric view of a base slide box of a preferred embodiment with a pin block in a final position.

Referring to FIG. 8A, the steps to install drawer box 102 in cabinet carcass 108 are shown. At step 802, frame 704 is rigidly affixed to the cabinet carcass with standard mounting hardware such as wood screws through mounting holes 708. At step 804, "L" bracket 306 is mounted to the back of the cabinet carcass with mounting hardware such as wood screws through mounting slots 522. If necessary, vertical or horizontal adjustments of the position of "L" bracket 306 can be made without completely removing the mounting hardware due to the slotted shape of mounting slots 522. At step 806, "U" bracket 302 is connected to front panel 202 and rear panel 211 with typical mounting hardware such as wood screws through mounting slots 314. Vertical adjustments of bracket 302 are possible through the length of mounting slots 314. At step 808, drawer box 102 is positioned over template 706 such that pin block 210 is adjacent redirecting surfaces 716 at first end 712 as shown in FIG. 8B. At step 810, as drawer box 102 is pushed inward towards the cabinet, redirecting surfaces 716 guide pin block 210 towards slot 710 as shown in FIG. 8C. At step 812, as drawer box 102 is further forced towards the cabinet, pin block 210 moves through the length of slot 710 to second end 714 effectively centering drawer box 102 over base slide box 106 as shown in FIG. 8D. Pin block 210 moves through slot 710 until front panel 202 abuts template 706, mounting holes 724 are adjacent mounting holes 208, and mounting holes 212 are aligned with mounting holes 718. At step 814, drawer box 102 is attached to template 706.

At step 816, "T" bracket 304 is attached to outer rail 406 such that outer rail is positioned in between and adjacent sides 510. Curves 530 hook around outer rail 406. Tabs 504 abut outer rail 406 and position outer rail 406 centrally between sides 510. The inward bias of tabs 504 allows "T" bracket 304 to accommodate different possible widths of outer rail 406. Once "T" bracket 304 is positioned on outer rail 406, flexible tabs 502 are bent downwardly such that hooks 503 engage mounting holes 408 on outer rail 406. The engagement of hooks 503 with mounting holes 408 prevents rail assembly 308 from sliding out of engagement with brackets 304 and 306.

At step 818, rail assembly 308 is attached to "L" bracket 306 such that outer rail 406 is positioned in between and adjacent sides 516. Curves 532 hook around outer rail 406. Tabs 518 abut outer rail 406 and position outer rail 406 centrally between sides 516. The inward bias of tabs 518 allows "L" bracket 306 to accommodate different possible widths of outer rail 406. The length of web 514 provides depth adjustment capability if needed. "T" bracket 304 is then mounted to the cabinet carcass at step 820.

Figure 9:
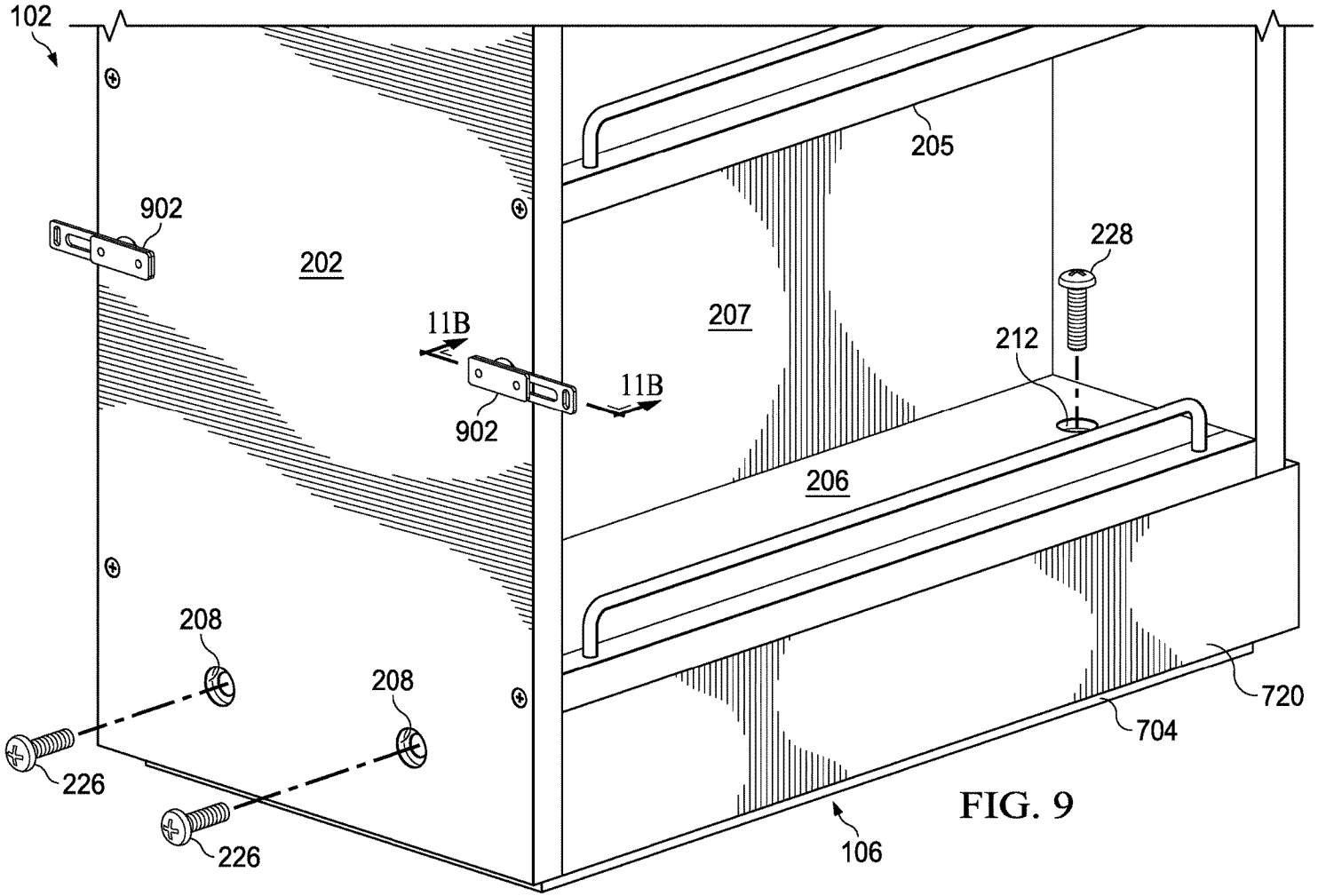
FIG. 9 is a partial isometric view of a drawer box mounted to a base slide box of a preferred embodiment.

Referring to FIG. 9, drawer box 102 is shown mounted to base slide box 106 in the stowed position (cabinet walls are not depicted). Screws 226 are used to attach drawer box 102 to base slide box 106 through mounting holes 208 and 724. Screws 228 are used to attach drawer box 102 to base slide box 106 through mounting holes 212 and 718 on both sides of vertical partition 207. Mounting system 902 is attached to front panel 202 and is used to adjustably attach a decorative face plate to front panel 202. It is understood that mounting system 902 can be implemented on any furniture or cabinet piece such as a base pullout, a filler pullout, a trash can pullout, or similar piece that incorporates a face plate.

Figure 10:
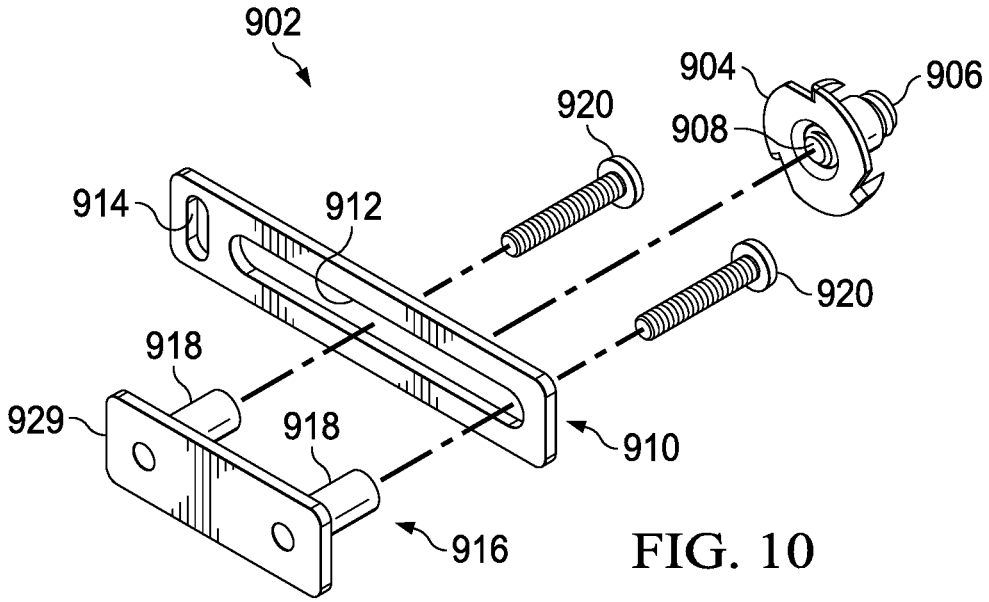
FIG. 10 is an isometric view of an adjustable face plate mounting system of a preferred embodiment.

Referring to FIG. 10, mounting system 902 comprises T-nut 904, slotted bracket 910, and standoff assembly 916. T-nut 904 includes a set of internal threads sized to engage set screw 906. Set screw 906 has a blunt surface 908 on one end. Slotted bracket 910 is generally rectangular and defines slot 912 through the majority of its length. Adjacent slot 912 at one end of slotted bracket 910 is attachment hole 914.

Standoff assembly 916 includes a pair of cylindrical, internally threaded standoffs 918 spaced a set distance apart from each other and extending from base 929. Standoffs 918 are slidably engaged with slot 912. Bolts 920 are externally threaded and sized to engage the internal threads of standoffs 918. Bolts 920 may be provided with a wide head or alternatively, washers may be used.

Figure 11A:
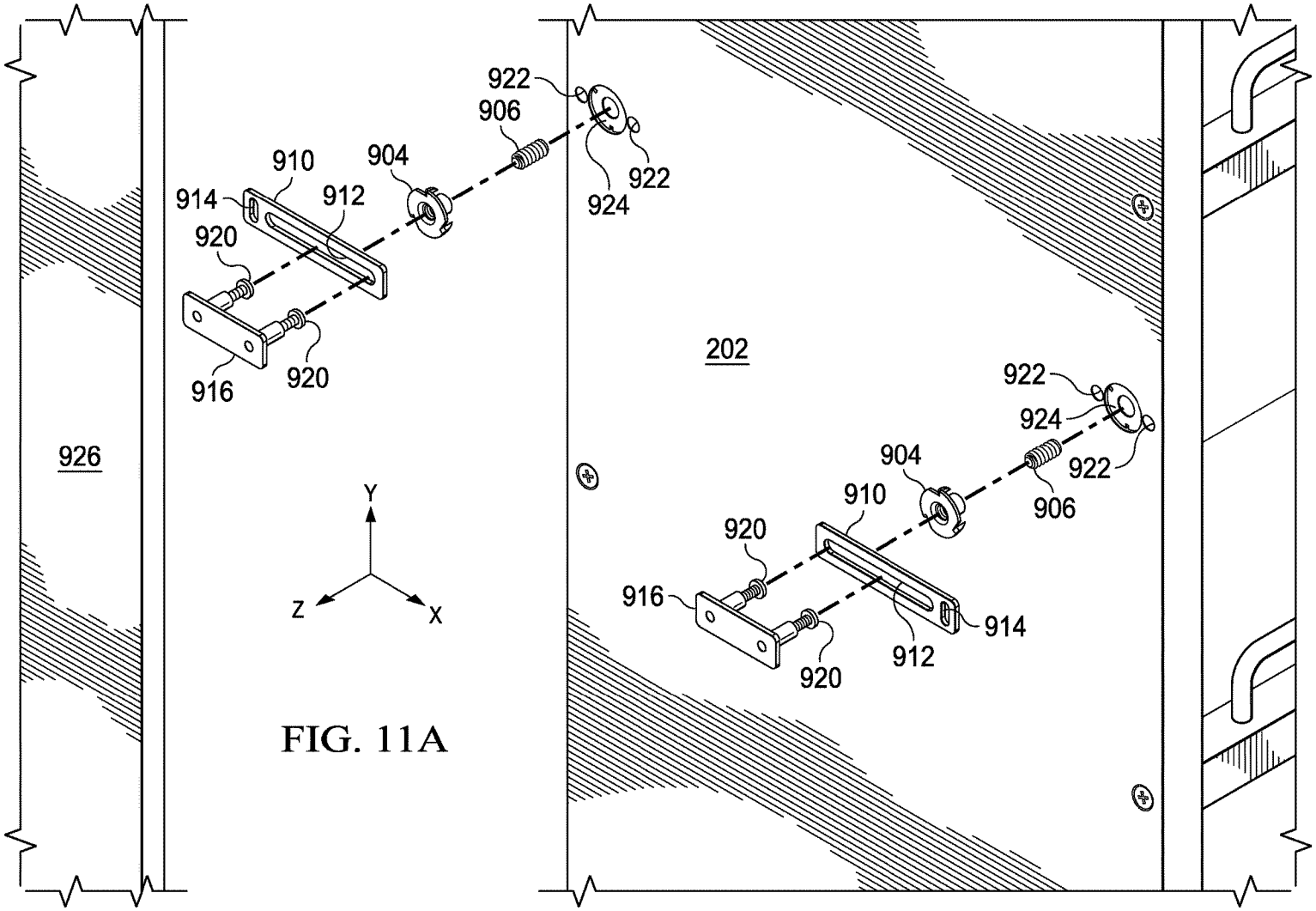
FIG. 11A is a partial exploded isometric view of an adjustable face plate mounting system and a front panel of a drawer box of a preferred embodiment.
Figure 11B:
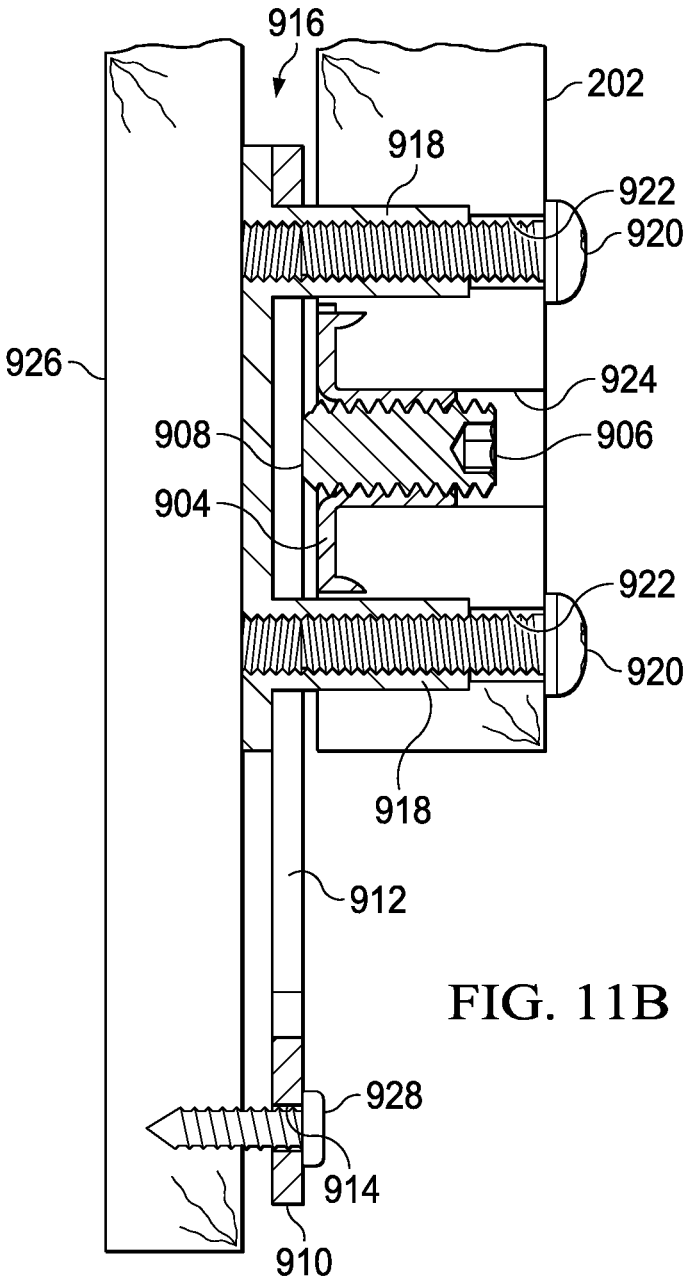
FIG. 11B is a partial cross-sectional view of an adjustable face plate mounting system attaching a face plate to a front panel of drawer box of a preferred embodiment taken along line 11B-11B of FIG. 9.

Referring to FIGS. 11A and 11B, face plate 926 is adjustably secured to front panel 202 via mounting system 902. Bore 924 passes through front panel 202 and includes a recess to accommodate the head of T-nut 904 so that T-nut 904 is ultimately flush with the surface of front panel 202. Holes 922 pass through front panel 202 and are linearly aligned with bore 924. Holes 922 are spaced and sized to accept both standoffs 918 of standoff assembly 916. Screw 928 attaches face plate 926 to slotted bracket 910 through attachment hole 914.

Figure 12:
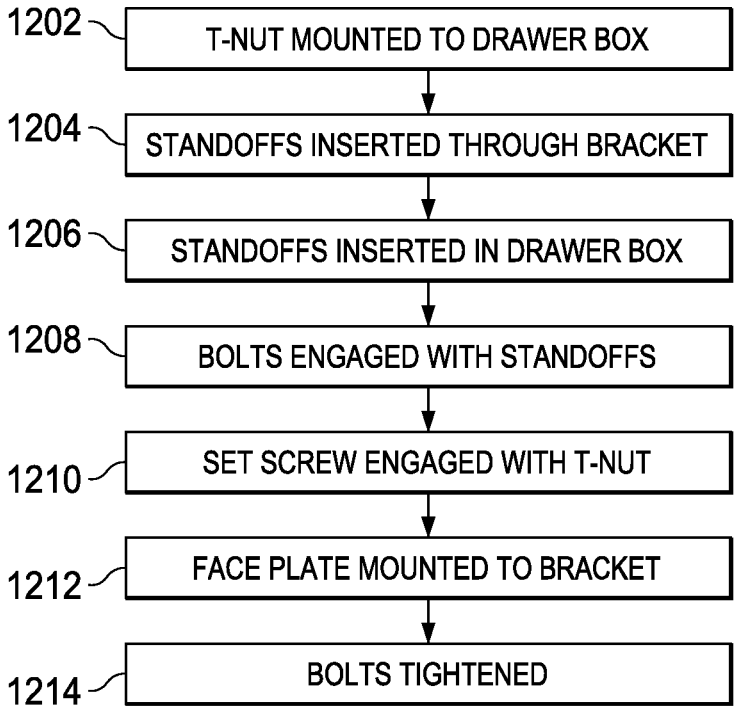
FIG. 12 is a flowchart of the steps involved in securing a face plate to a drawer box of a preferred embodiment.

Referring to FIG. 12, the steps to secure face plate 926 to front panel 202 are shown. At step 1202, T-nut 904 is rigidly mounted to front panel 202 in bore 924. At step 1204, after removing bolts 920 from standoffs 918, standoffs 918 are inserted through slot 912. At step 1206, standoffs 918 are inserted in holes 922 such that standoffs 918 terminate within panel 202. At step 1208, bolts 920 are threadably engaged with standoffs 918 and tightened to the point that base 929 is adjacent slotted bracket 910 and slotted bracket is adjacent front panel 202. At step 1210, set screw 906 is threadably engaged with T-nut 904 such that blunt surface 908 abuts slotted bracket 910. Typical mounting hardware such as wood screws are used to mount face plate 926 to slotted bracket 910 through attachment hole 914 at step 1212. At step 1214, bolts 920 are tightened. It is preferred that a complete mounting system 902 is fitted proximate each corner of front panel 202.

Figure 13:
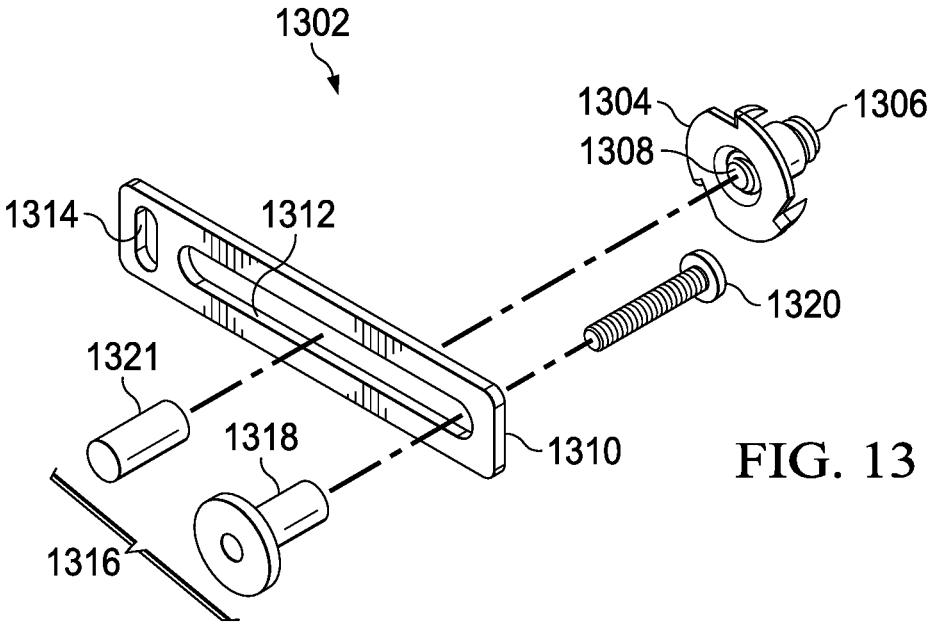
FIG. 13 is an isometric view of an adjustable face plate mounting system of a preferred embodiment.

Referring to FIG. 13, an alternate embodiment mounting system 1302 is shown. Mounting system 1302 comprises T-nut 1304, slotted bracket 1310, and standoff assembly 1316. T-nut 1304 includes a set of internal threads sized to engage set screw 1306. Set screw 1306 has a blunt surface 1308 on one end. Slotted bracket 1310 is generally rectangular and defines slot 1312 through the majority of its length. Adjacent slot 1312 at one end of slotted bracket 1310 is attachment hole 1314. Standoff assembly 1316 comprises a cylindrical, internally threaded standoff 1318. Standoff 1318 is slidably engaged with slot 1312. Bolt 1320 is externally threaded and sized to engage the internal threads of standoff 1318. Bolt 1320 may be provided with a wide head or alternatively, washers may be used. Alternatively, standoff 1318 may be externally threaded and fitted with a securing nut. Pin 1321 is generally cylindrical with a diameter approximately equivalent to the diameter of standoff 1318. Pin 1321 is slidably engaged with slot 1312.

Figure 14A:
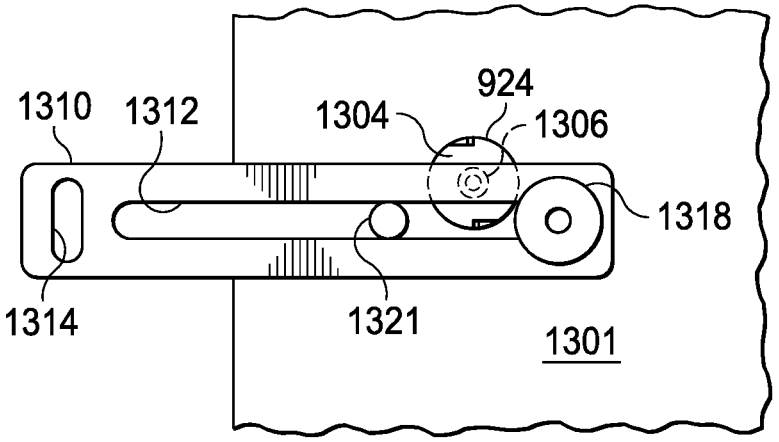
FIG. 14A is a partial elevation view of an adjustable face plate mounting system and a front panel of a drawer box of a preferred embodiment.
Figure 14B:
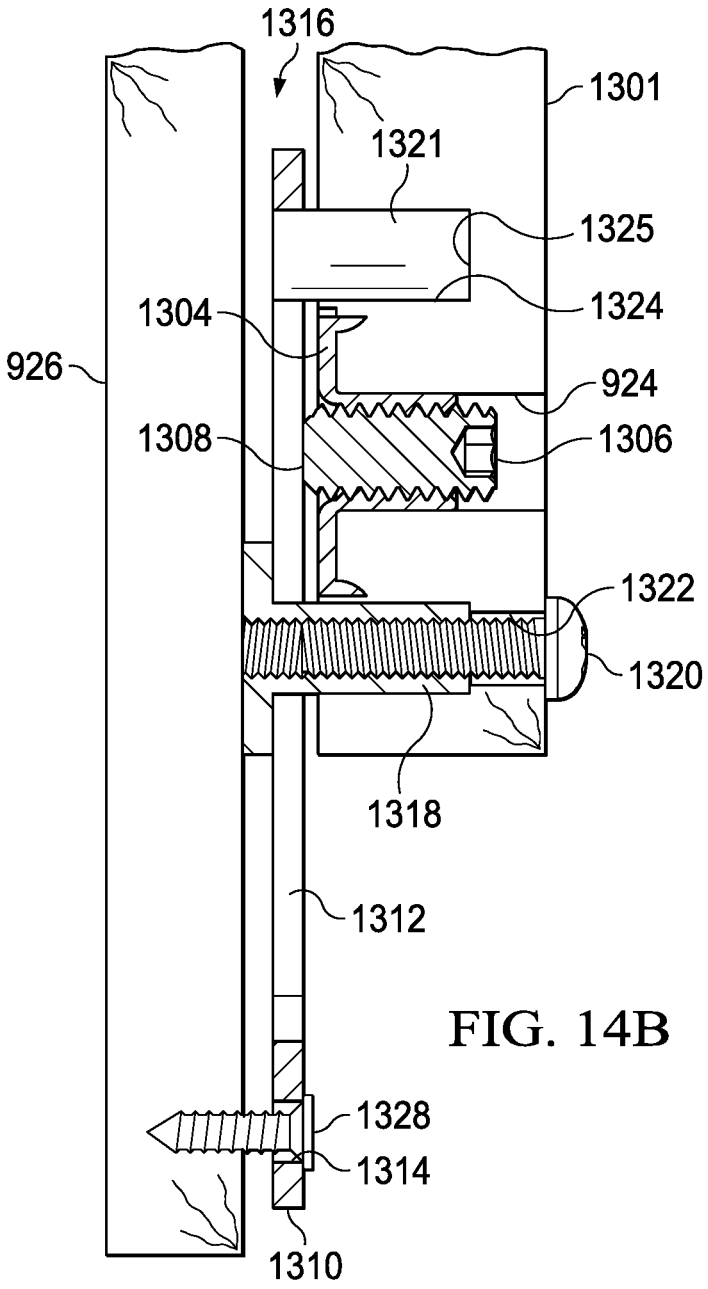
FIG. 14B is a partial cross-sectional view of an adjustable face plate mounting system attaching a face plate to a front panel of drawer box of a preferred embodiment.

Referring to FIGS. 14A and 14B, face plate 926 is adjustably secured to front panel 1301 via mounting system 1302. Bore 924 passes through front panel 1301 and includes a recess to accommodate the head of T-nut 1304 so that T-nut 1304 is ultimately flush with the surface of front panel 1301. Hole 1322 passes through front panel 1301. Hole 1324 has end 1325. Hole 1322 is sized to accept standoff 1318 and hole 1324 is sized to accept pin 1321. Screw 1328 attaches face plate 926 to slotted bracket 1310 through attachment hole 1314.

The position of face plate 926 relative to front panel 1301 can be adjusted in three dimensions in order to ensure that the face plate aligns with adjacent cabinets.

Figure 15A:
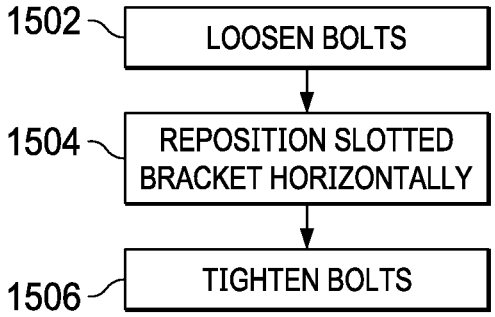
FIG. 15A is a flowchart of the steps involved in adjusting a horizontal position of a face plate relative to a drawer box of a preferred embodiment.

Referring to FIG. 15A, the steps to make a lateral adjustment of face plate 926 relative to front panel 1301 (direction X) are shown. Bolts 920 are loosened at step 1502. At step 1504, face plate 926 and slotted bracket 910 are moved horizontally together such that slotted bracket 910 slides on standoffs 918 in direction X along slot 912. At step 1506, bolts 920 are tightened.

Figure 15B:
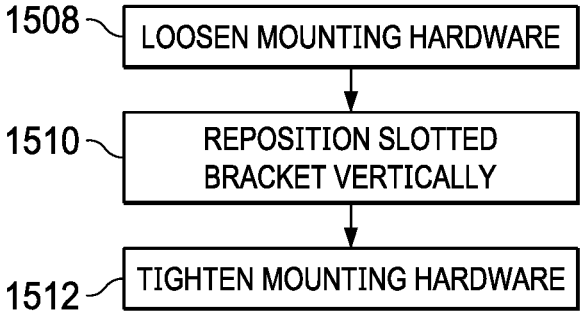
FIG. 15B is a flowchart of the steps involved in adjusting a vertical position of a face plate relative to a drawer box of a preferred embodiment.

Referring to FIG. 15B, the steps to make a vertical adjustment of face plate 926 relative to front panel 1301 (direction Y), are shown. Screw 928 securing face plate 926 to slotted bracket 910 through attachment hole 914 is loosened at step 1508. At step 1510, face plate 926 is moved vertically such that screw 928 slides along attachment hole 914 in direction Y. At step 1512, screw 928 securing face plate 926 to slotted bracket 910 through attachment hole 914 is tightened.

Figure 15C:
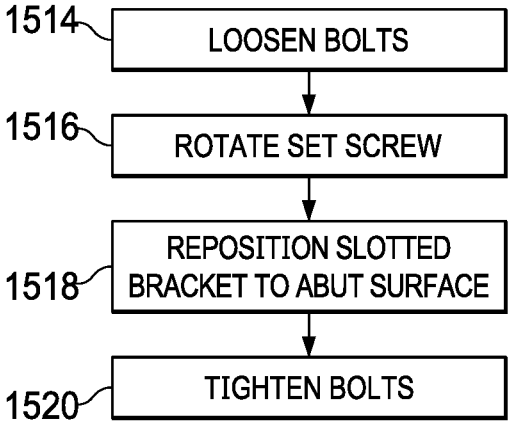
FIG. 15C is a flowchart of the steps involved in adjusting a depth position of a face plate relative to a drawer box of a preferred embodiment.

Referring to FIG. 15C, the steps to make a depth adjustment of face plate 926 relative to front panel 1301 (direction Z), are shown. Bolts 920 are loosened at step 1514. At step 1516, set screw 906 is rotated and advanced or retreated through T-nut 904 in direction Z. At step 1518 slotted bracket 910 is positioned to abut surface 908. At step 1520, bolts 920 are tightened.

It will be appreciated by those skilled in the art that modifications can be made to the embodiments disclosed and remain within the inventive concept. Therefore, this invention is not limited to the specific embodiments disclosed, but is intended to cover changes within the scope and spirit of the claims.

The invention claimed is:

1. A method for adjustably connecting a face plate to a cabinet piece movably engaged with a cabinet carcass, the method comprising:

providing a first mounting hole and a second mounting hole in the cabinet piece;

providing a bracket, defining a slot, for slidable engagement with a standoff assembly;

inserting the standoff assembly through the slot in the bracket;

inserting the standoff assembly in the first mounting hole and the second mounting hole;

attaching the face plate to the bracket; and, securing the standoff assembly to the cabinet piece.

2. The method for adjustably connecting a face plate to a cabinet piece of claim 1 comprising:

adjusting a horizontal position of the face plate with respect to the cabinet piece; and, adjusting a vertical position of the face plate with respect to the cabinet piece.

3. The method for adjustably connecting a face plate to a cabinet piece of claim 1 comprising:

providing the standoff assembly comprises a first standoff and a pin;

inserting the first standoff in the first mounting hole;

inserting the pin in the second mounting hole; and, engaging a bolt with the first standoff adjacent the cabinet piece.

4. The method for adjustably connecting a face plate to a cabinet piece of claim 1 comprising:

providing the standoff assembly comprises a first standoff and a second standoff;

inserting the first standoff in the first mounting hole;

inserting the second standoff in the second mounting hole; and, engaging a first bolt with the first standoff adjacent the cabinet piece and a second bolt with the second standoff adjacent the cabinet piece.

5. The method for adjustably connecting a face plate to a cabinet piece of claim 1 comprising:

loosening the attachment of the standoff assembly to the cabinet piece;

repositioning the bracket horizontally with respect to the cabinet piece; and, tightening the attachment of the standoff assembly to the cabinet piece.

6. The method for adjustably connecting a face plate to a cabinet piece of claim 1 comprising:

loosening the attachment of the face plate to the bracket;

repositioning the face plate vertically with respect to the cabinet piece; and, tightening the attachment of the face plate to the bracket.

7. The method for adjustably connecting a face plate to a cabinet piece of claim 1 comprising:

providing a set screw removably engaged with the cabinet piece and adjacent the bracket.

8. The method for adjustably connecting a face plate to a cabinet piece of claim 7 comprising:

loosening the attachment of the standoff assembly to the cabinet piece;

adjusting the set screw to move the set screw within the cabinet piece;

abutting the bracket with the set screw;

repositioning a depth position of the bracket with respect to the cabinet piece; and, tightening the attachment of the standoff assembly to the cabinet piece.

9. A mounting system for adjustably attaching a face plate to a pullout cabinet piece comprising:

a frame movably engaged with a cabinet carcass;

a first mounting hole in the frame and a second mounting hole in the frame, where the first mounting hole is spaced from the second mounting hole by a distance;

a bracket defining a slot and an attachment hole;

a standoff assembly slidably engaged with the slot and inserted into the first mounting hole and the second mounting hole; and, the face plate attached to the bracket with a fastener through the attachment hole.

10. The adjustable mounting system of claim 9 wherein the standoff assembly further comprises:

a first standoff mounted in the first mounting hole.

11. The adjustable mounting system of claim 10 wherein the standoff assembly further comprises:

a bolt threadably engaged with the first standoff.

12. The adjustable mounting system of claim 11 wherein the standoff assembly further comprises:

a pin mounted in the second mounting hole.

13. The adjustable mounting system of claim 9 wherein the standoff assembly further comprises:

a first standoff spaced apart the distance from a second standoff.

14. The adjustable mounting system of claim 13 wherein the standoff assembly further comprises:

a first bolt removably engaged with the first standoff.

15. The adjustable mounting system of claim 14 wherein the standoff assembly further comprises:

a second bolt removably engaged with the second standoff.

16. The adjustable mounting system of claim 9 further comprising:

a first lateral position of the face plate relative to the frame when the standoff assembly is in a first position along the slot; and, a second lateral position of the face plate relative to the frame when the standoff assembly is in a second position along the slot.

17. The adjustable mounting system of claim 9 further comprising:

a first vertical position of the face plate relative to the frame when the fastener is in a first position within the attachment hole; and, a second vertical position of the face plate relative to the frame when the fastener is in a second position within the attachment hole.

18. The adjustable mounting system of claim 9 further comprising:

a bore hole through the frame;

a T-nut fixedly attached to the frame in the bore hole; and, a set screw adjustably engaged with the T-nut and adjacent the bracket.

19. The adjustable mounting system of claim 18 further comprising:

a first depth position of the face plate relative to the frame when the set screw is in a first position within the T-nut.

20. The adjustable mounting system of claim 19 further comprising:

a second depth position of the face plate relative to the frame when the set screw is in a second position within the T-nut.

* * * * *